United States Patent [19]

Caswell

[11] 4,213,779

[45] Jul. 22, 1980

[54] TREATMENT OF STEEL MILL WASTE MATERIALS

[75] Inventor: Bruce F. Caswell, Whitmore Lake, Mich.

[73] Assignee: Arcanum Corporation, Ann Arbor, Mich.

[21] Appl. No.: 834,304

[22] Filed: Sep. 19, 1977

[51] Int. Cl.[2] ..... C22B 1/16; C22B 1/243; C22B 1/244; C21B 13/00

[52] U.S. Cl. ..... 75/34; 23/313 R; 75/3; 75/5; 264/9; 264/111; 264/117

[58] Field of Search ..... 75/3, 4, 5, 29, 34, 75/35; 23/313 R, 313 AS; 264/9, 111, 117

[56] References Cited

U.S. PATENT DOCUMENTS

| | | | |
|---|---|---|---|
| 3,268,071 | 8/1966 | Puddington et al. | 264/9 |
| 3,307,927 | 3/1967 | Müschenborn | 75/3 |
| 3,368,004 | 2/1968 | Sirianni et al. | 23/313 R |
| 3,377,146 | 4/1968 | Von Stroh | 75/3 |
| 3,471,267 | 10/1969 | Copes et al. | 366/228 |
| 3,536,475 | 10/1970 | Trub | 75/3 |
| 3,969,103 | 7/1976 | Copes et al. | 75/3 |
| 4,003,737 | 1/1977 | Caswell et al. | 75/3 |
| 4,004,918 | 1/1977 | Fukuoka et al. | 75/25 |
| 4,082,539 | 4/1978 | Sugawara | 75/3 |

*Primary Examiner*—L. Dewayne Rutledge
*Assistant Examiner*—Michael L. Lewis
*Attorney, Agent, or Firm*—Blanchard, Flynn, Thiel, Boutell & Tanis

[57] ABSTRACT

Steel mill wastes are treated to recover the iron values thereof by a two stage agglomeration process wherein relatively small size first agglomerates are formed by agglomeration of steel mill wastes from an aqueous suspension thereof and then relatively large size second agglomerates are formed by agglomeration of said first agglomerates from a suspension thereof in a hydrophobic organic liquid and simultaneously a reactant chemical reacts with the agglomerates to provide a solid binder material formed in situ during the second agglomeration procedure.

10 Claims, 2 Drawing Figures

TREATMENT OF STEEL MILL WASTE MATERIALS

This invention relates to a process for treating steel mill wastes and recovering the iron values thereof in the form of pellets suitable for feeding to a blast furnace.

A variety of iron-rich by-products are produced in steel mills. Such by-products principally comprise mill scale, various dusts including ore dusts, basic oxygen furnace dusts, open hearth dusts, blast furnace flue dusts, spark box fines and grit chamber dusts, and sludges produced at various places in the steel mill, such as in gas purification operations. These by-products typically contain 30 to 75 wt.% iron and the balance is various other materials such as carbon, lime, slag, silica, etc. The larger particles can be screened out and returned to the blast furnace, but the finer particles must be agglomerated before they can be reused. Typically, particles of −10 mesh size or smaller are agglomerated before reuse. Many of the above-mentioned dusts have a particle size of −400 mesh and these are especially difficult to agglomerate to form pellets useful as a feed to a blast furnace. It is usually desired to use +6 mesh particles or pellets as the iron-bearing component fed to a blast furnace and it is preferred to use pellets of larger size, such as about ½ inch pellets.

Various processes have been adopted and used for agglomerating such steel mill wastes, but these have not been completely satisfactory because of excessive energy requirements, high equipment, operating and maintenance costs, inability to agglomerate all the steel mill wastes, particularly very fine wastes, and poor pellet properties.

The broad process of forming an agglomerated product, as a pellet or a ball, from a suspension of solid material or materials in a finely divided form has long been known and certain specific processes utilizing the basic concept are set forth in a variety of United States and other patents. Examples of these patents are those to Puddington and Farnand U.S. Pat. No. 3,268,071, Sirianni and Puddington U.S. Pat. No. 3,368,004 and Capes et al U.S. Pat. No. 3,471,267. Briefly, all three of these patents refer to a procedure wherein the powders are suspended in a first liquid which is lyophobic to said powders, a second or bridging liquid is then added thereto which is chosen or treated so as to be lyophilic to at least certain of said powders and the system is then agitated. This forms the material which is lyophilic to the bridging liquid into a plurality of agglomerates whose size and shape depend on the details of said procedure as same are set forth at length in said patents and to which reference is invited. These procedures may be and are used both for the separation of one of a mixture of solids from such mixture and such is the main purpose of the above-mentioned Puddington U.S. Pat. No. 3,268,071, or they may be and are used where the formation of the agglomerated product is the objective itself of the agglomeration procedure and such is the principal purpose of the other two patents above-named.

It is not possible to effectively agglomerate steel mill wastes into pellets of the desired size and suitable for feeding to a blast furnace by the procedures described in these patents because the products thereof are of insufficient hardness and crushing strength, particularly when relatively large size pellets are to be formed.

Accordingly it is an object of this invention to provide an improved process for preparing relatively large-size agglomerates of steel mill wastes wherein the agglomerates possess relatively high density, relatively high hardness and relatively high crushing strength such that they can easily and conveniently be used as a source of iron for a steelmaking process.

Figure 1:
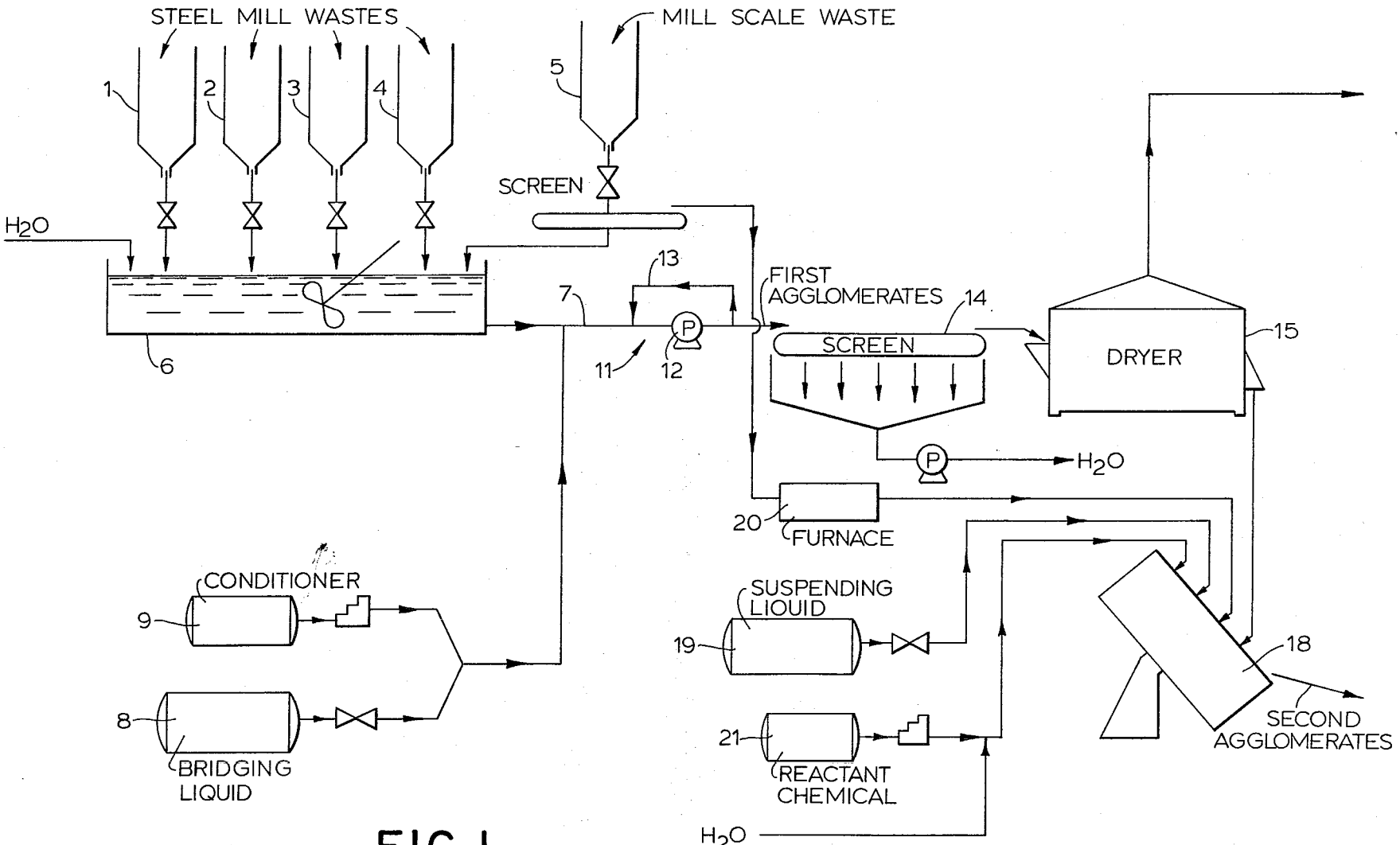
FIG. 1 is a schematic flow diagram of the first portion of the process.
Figure 2:
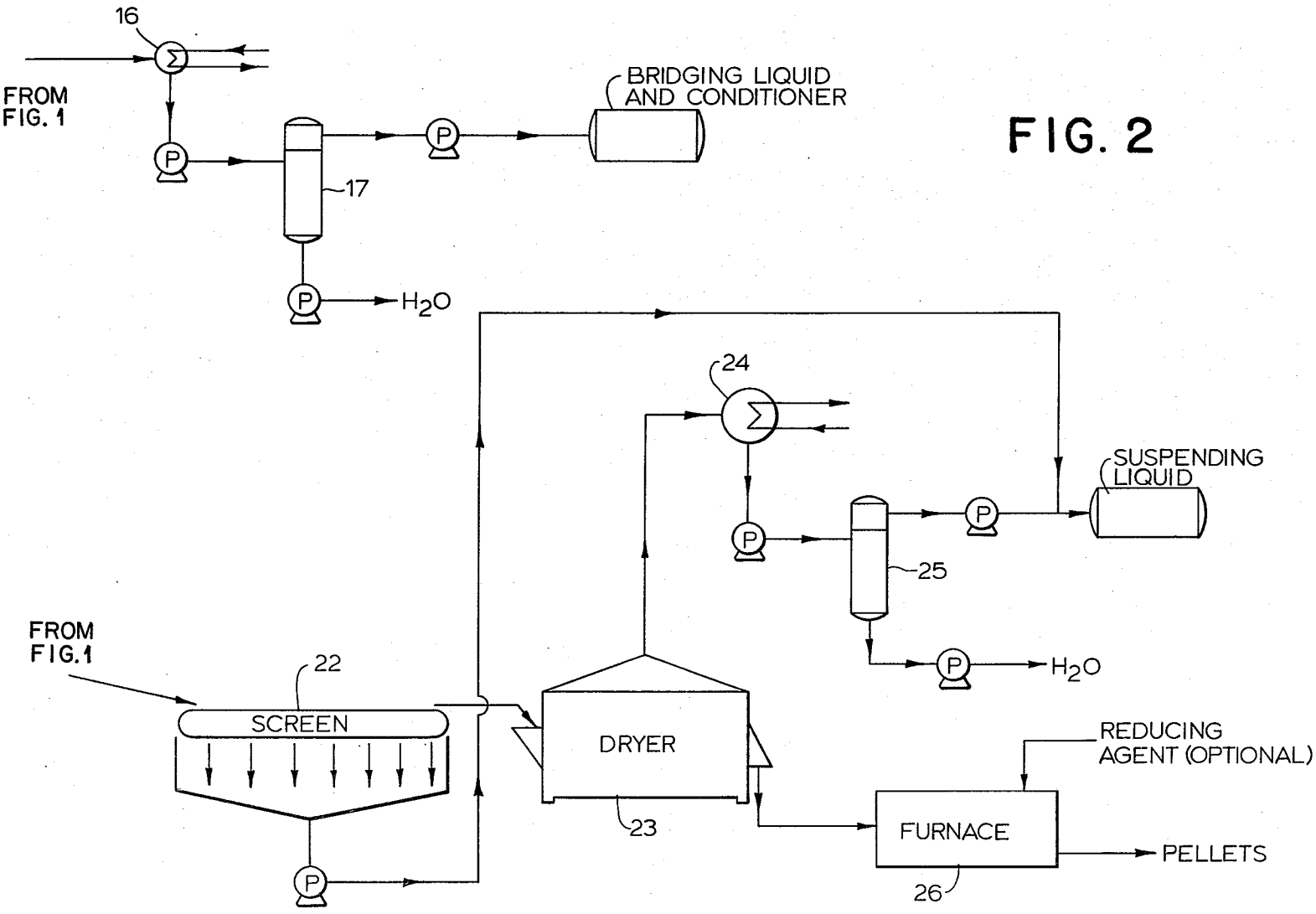
FIG. 2 is a schematic flow diagram of the second portion of the process.

Briefly, the invention provides a process for forming agglomerates from particles of iron-containing steel mill waste, which comprises the steps of:

a. forming a suspension of said steel mill waste particles in water as the continuous phase, b. adding to said suspension (i) a first hydrophobic organic liquid which is immiscible with water and (ii) a liquid conditioning agent effective to render the surfaces of said particles hydrophobic, whereby to form a two-phase liquid system containing said particles in suspension, c. agitating the two-phase liquid system to effect repeated collisions of said particles and thereby forming in said system a dispersion of first, relatively small size agglomerates in said first hydrophobic organic liquid, said first agglomerates consisting essentially of agglomerates of said steel mill waste particles, d. discontinuing said agitation and separating said first agglomerates from said water, said first hydrophobic organic liquid and said conditioning agent, e. then forming a second suspension of said first agglomerates in a second hydrophobic organic liquid which is immiscible with water, as the continuous phase, f. adding to said second suspension an aqueous solution of a chemical which is reactive with iron to form a solid reaction product capable of binding together said first agglomerates, whereby to form a second two-phase liquid system containing said first agglomerates in suspension, g. agitating said second two-phase liquid system to effect repeated collisions of said first agglomerates and thereby forming in said system a dispersion of second, relatively large size agglomerates, said second agglomerates consisting essentially of agglomerates of said first, relatively small size agglomerates, and simultaneously effecting a chemical relation between said chemical and iron present in said agglomerates whereby to form said solid reaction product in situ in said second two-phase liquid system, which reaction product binds together said first agglomerates to form said second agglomerates, h. discontinuing the agitation, and then recovering said second agglomerates substantially free of water and said second hydrophobic organic liquid.

If desired, the second agglomerates can be calcined, sintered or bound together by other binding agents, such as cement.

Inasmuch as the present invention can make use of well-known equipment, the details of suitable equipment are not disclosed herein. Reference may be made to the three patents noted above, particularly U.S. Pat. Nos. 3,368,004 and 3,471,267 for further details concerning useful equipment and details of agglomeration procedures.

Referring to the drawing, there is shown a schematic diagram of the equipment used in the process of the invention. A plurality of storage tanks, 1, 2, 3, 4 and 5 are provided for holding various different types of steel mill wastes that are produced at various locations in the steel mill. Normally, different wastes obtained from different locations are stored in different storage tanks, although this is not a requirement of the invention. It is an advantage of the invention that various types of wastes can be processed either singly or in combination, to produce pellets. Accordingly, although the following description will proceed by referring to the simultaneous processing of a plurality of different steel mill wastes, it will be understood that the invention can also be used to process a single steel mill waste if desired. In the disclosed embodiment the storage tank 5 is considered as containing mill scale waste for purposes to be described hereinbelow. However, this is not a critical requirement for the invention.

Mill scale waste is iron oxide that forms on the surface of slabs, sheets, blooms, billets and bars during the rolling process. As the steel is rolled this layer of scale is broken off and it drops into a flume or sewer. Most mill scale has a particle size of −10 to +100 mesh size. The mill scale is screened and particles thereof of less than about ⅛ inch size are fed into tank 5.

The steel mill wastes from tanks 1, 2, 3 and 4 and a portion of the mill scale waste from tank 5 are fed into a mixing tank 6 containing water and they are agitated therein to form a pumpable slurry of the steel mill wastes in water. Typically the slurry contains about 15 to 25 wt.% solids. Larger amounts of water can be used, if desired, but it is advantageous to use as little water as possible consistent with forming a pumpable slurry. The aqueous slurry is withdrawn from the mixing tank 6 and is flowed through a conduit 7. A liquid or combination of liquids which preferentially wet the solid particles is injected into the slurry from the tank 8. The liquid is substantially immiscible with water and displaces the water from the surfaces of the suspended solids. Such liquids are hydrophobic organic liquids such as fuel oil, toluene, kerosene, nitrobenzene, chlorinated hydrocarbons such as carbon tetrachloride, perchloroethylene or trichloroethane, and the like. The hydrophobic organic liquids are sometimes hereinafter referred to as bridging liquids in view of their function of creating bridges between the solid particles whereby to form agglomerates. A conditioner liquid is also injected into the aqueous slurry from the tank 9 in order to condition the surfaces of the solid particles. Conditioners are substances which are physically or chemically adsorbed at the solid-liquid interface. The conditioner will usually have a balanced hydrophilic-hydrophobic molecular structure and it is adsorbed on the solid with the hydrophobic portion oriented outwardly so that the solid will be wetted by the bridging liquid. Organic acids and xanthates and their soluble salts, alcohols and amines, all having a large hydrocarbon nucleus, are useful as conditioners, as is well known. In the illustrated embodiment, fuel oil is employed as the bridging liquid and tall oil is used as the conditioning agent. The amounts of bridging liquid and tall oil are selected so that good quality, reasonably dense agglomerates are obtained in the following agglomeration step. The amounts can be determined by routine experimentation on the particular suspension of steel mill waste being used. U.S. Pat. No. 3,368,004 describes the criteria for selecting the proportions and reference can be made thereto for additional description concerning this. Typically, the amount of conditioning agent is from about 0.1 to 5% by weight and the amount of bridging liquid is from about 3% to 15% by weight, both percentages being based on the weight of the aqueous slurry.

The combined stream of the aqueous slurry, the conditioning agent and the bridging liquid is agitated in a first agglomeration system 11 whereby to form agglomerates of the solids present in the slurry. The agitating and agglomerating mechanism 11 can be selected from among the equipment known to be useful for this purpose including reciprocal shakers, rotating drums, pump loops (shown in the drawing), tanks with propeller-type agitators and in-line mixers. The particular equipment used will depend on the desired properties of the agglomerates, i.e., density. Shakers will be used when agglomerates of high density and strength are wanted. However, for most purposes, the agglomerates formed in the first agglomeration stage 11 need not possess high density and strength. Under these circumstances a pump loop is a highly effective agitating and agglomerating apparatus and is preferred because of its ease of operation.

In the illustrated apparatus, the first agglomeration system is a pump loop comprised of a centrifugal pump 12 and a feedback conduit 13 for returning a selected portion of the discharge of the pump to the inlet thereof. If desired, a flow controller (not shown) can be provided in the feedback conduit 13 for adjusting the flow rate of the recycle stream and thereby controlling the average residence time of the combined stream in the pump loop. During the time they are present in the pump loop, the finely divided solid particles are formed into compact agglomerates wherein the finely divided particles are held together owing to the formation of liquid bridges between the particles caused by the presence of the briding liquid. The bridging liquid is insoluble in and is immiscible with the aqueous liquid phase and it preferentially wets the finely divided particles by displacing the aqueous phase, whereby to cause the particles to bond together. The product (first agglomerate) discharged from the pump loop is a slurry or suspension of agglomerates in an aqueous liquid phase. These agglomerates typically are of relatively small size such as from 1/64 to ⅛ inch in particle size. They are relatively dense.

The first agglomerates are then separated from the aqueous phase. In the illustrated embodiment the product discharged from the pump loop is fed onto a screen 14 wherein the drainable water passes through the screen and is recovered for recycle to the mixing tank 6. Other apparatuses that can be used for this purpose are filters, settling vessels and centrifuges. The first agglomerates, removed as the overflow, are fed to a dryer 15 wherein they are heated to a temperature effective to vaporize almost all of the water, conditioning agent and bridging liquid therefrom. For example, the drier can be heated at a temperature of about 330° F.

The vapors from the dryer 15 are condensed in a condenser 16 and the condensate is fed to a separation tank 17 wherein the aqueous phase is separated from the organic phase. These phases can be recycled to the mixing tank 6.

The substantially dry agglomerates discharged from the dryer 15 can still contain small amounts of water, conditioning agent and bridging liquid. It is an advantage of the invention that the drying of the agglomerates in the dryer 15 is carried out under relatively mild conditions sufficient to remove only the readily removable water, conditioning agent and bridging liquid from the first agglomerates.

The substantially dry, relatively small size, first agglomerates discharged from the dryer 15 are fed into a second agitating and agglomerating device 18. The second agitating and agglomerating device 18 is here shown as being a rotating tumbler drum, but it is apparent that other devices such as rotating discs, reciprocable shakers, etc. can also be used. A hydrophobic organic suspending liquid is fed from tank 19 into the agglomerating device 18 whereby to form in said device 18 a slurry of said relatively small size agglomerates suspended in said hydrophobic organic suspending liquid. There is also fed into the second agglomerating device 18 a stream of mill scale particles from the tank 5. The mill scale particles are dried in a furnace 20 prior to feeding them into the second agglomerating device. The mill scale particles have a size of greater than about ⅛ inch and they function in the nature of nucleating particles for the second agglomeration that occurs in the second agglomerating device 18. Water is also fed into the second agglomerating device 18 and it functions as the bridging liquid in the second agglomeration procedure. To the water there is added from tank 21 a reactive chemical capable of reacting with Fe and possibly with other materials contained in the steel mill waste to produce a reaction product which will act as a strong bonding agent between the first agglomerates. Effective reactive chemicals include mineral acids such as hydrochloric acid and nitric acid. It is preferred to use nitric acid. The amount of the reactive chemical added will be selected so as to achieve the formation of hard, dense, relatively large-size agglomerates in the second agglomeration device 18. The amount of reactant chemical used can be determined for any particular feed material by routine experimentation. When nitric acid is used, the concentration thereof in the aqueous bridging liquid is from about 0.5 to about 5.0 percent by weight, preferably about 1 to 3 percent by weight.

The agglomeration procedure in the second agglomeration device 18 is similar to that described in U.S. Pat. No. 4,003,737, the entire contents of which are incorporated herein by reference, and detailed description thereof is believed to be unnecessary.

In the second agglomeration device 18, the relatively small size first agglomerates formed in the first agglomeration device are further agglomerated to form relatively large size second agglomerates which typically are balls having a diameter of about ½ inch. It is preferred to feed mill scale into the second agglomerating device, in addition to the relatively small size agglomerates from dryer 15, because the particles of mill scale act as nucleating agents and reaction sites for reaction with the reactant chemical in order that the reaction products will form solid bridges between the small-size first agglomerates and the mill scale, whereby large size second agglomerates are readily formed. However, the mill scale supplied from tank 5 can be omitted, in which case the reactant chemical will react solely with the small-size agglomerates. In that case, the properties of strength and density of the large-size agglomerate product are slightly inferior to the properties thereof when mill scale is used.

The amount of mill scale that is supplied to the second agglomeration device can be up to about 20 percent by weight, preferably from 5 to 15 percent by weight, based on the weight of the small-size first agglomerates fed in from the drier 15. The hydrophobic organic liquid employed as the suspending liquid can be selected from the same materials useful as the first bridging liquid in the first agglomerator 11, such as fuel oil.

The relatively large-size agglomerates discharged from the second agglomerator 18 are separated from the hydrophobic liquid by decanting, filtering or screening such as by the screen 22. The fuel oil recovered thereat can be recovered and recycled. The second agglomerates are then dried in a dryer 23 whereby to remove most of the water and fuel oil remaining thereon by vaporization thereof. The vapors are condensed in condenser 24 and are separated in separator 25 into an aqueous phase and an organic phase, which can be recycled. The dryer will be operated at a temperature effective to vaporize those liquids, such as about 330° F. The elevated temperature in the drying step will accelerate the reaction between the particles and residual reactant chemical whereby to increase the crushing strength of the large-size second agglomerates.

The iron values in the large size second agglomerates are principally in the form of iron oxides. The large-size agglomerates can be calcined or sintered in furnace 26 to further improve the crushing strength thereof. When it is desired to reduce the iron oxides to elemental iron, heating can be carried out in a reducing atmosphere. The calcination operation can be carried out at a suitable calcination temperature such as from 1500° to 2200° F., whereas sintering can be carried out at a higher temperature in the range of from about 75 to 100% of the melting point of the second agglomerates.

It is also possible to employ different procedures in lieu of calcination, such as mixing the dried second agglomerates with cement or other binder materials as disclosed in, for example, U.S. Pat. No. 3,235,371.

EXAMPLE

Steel mill centrifuge sludge is fed from tank 1 at a rate of 8.75 tons per hour (TPH), grit chamber dust is fed from tank 2 at a rate of 2.94 TPH, clarifier grit is fed from tank 3 at a rate of 0.5 TPH, flue dust is fed from tank 4 at a rate of 3.75 TPH, mill scale having a size of less than ⅛ inch is fed at a rate of 4.08 TPH and 18219 gallons per hour (GPH) of water is fed into tank 6 having a capacity of 6000 gallons and is formed into a slurry therein. The slurry is removed at a rate of 20040 GPH. Into the slurry there is injected 107 GPH of tall oil and 1082 GPH of fuel oil #1. The pump loop 11 has a capacity of 63720 GPH. The slurry is fed onto a screen 14 of 10 mesh size and 18660 GPH of water and fine particles is removed as the underflow. The overflow of 26.46 TPH is fed into dryer 15 operating at 330° F., whereby 2.2 TPH of water, 0.38 TPH of tall oil and 3.43 TPH of fuel oil are removed as vapor. The solid from dryer 15 comprises 20.05 TPH solids, 0.2 TPH $H_2O$, 0.02 TPH tall oil and 0.18 TPH fuel oil. This solid is fed into second agglomerator 18, together with 2.04 TPH of mill scale having a particle size of ⅛ inch or larger, 15766 GPH fuel oil, 26.9 GPH nitric acid and 1581 GPH water. The second agglomerates formed in the second agglomerator 18 have a size of about ½ inch. The second agglomerate and liquids are removed from the second agglomerator and are screened on a 3 mesh screen. Fuel oil and fine particles are removed as underflow at a rate of about 15000 GPH. The overflow is fed to a dryer operating at 330° F. and a vapor of 6.57 TPH of water and 2.9 TPH of fuel oil is removed as vapor. The solids are discharged from the dryer at a rate of 22.26 TPH of $Fe_2O_3$ and containing 0.22 TPH of $H_2O$. The solids are calcined at 2000° F. and carbon is fed in at the rate of 3.7 TPH. There is obtained an iron-rich pellet product at a rate of 15.8 TPH and containing about 60 wt.% of iron.

The embodiments of the invention in which an exclusive property or privilege is claimed are defined as follows:

1. A process for forming agglomerates from particles of iron-containing steel mill waste, which comprises the steps of:

a. forming a suspension of said steel mill waste particles in water, b. adding to said suspension (i) a first hydrophobic organic liquid which is immiscible with water and (ii) a liquid conditioning agent effective to render the surfaces of said particles hydrophobic, whereby to form a two-phase liquid system containing said particles in suspension, c. agitating the two-phase liquid system to effect repeated collisions of said particles and thereby forming in said system a dispersion of first, relatively small size agglomerates in said first hydrophobic organic liquid, said first agglomerates consisting essentially of agglomerates of said steel mill waste particles, d. discontinuing said agitation and separating said first agglomerates from water, said first hydrophobic organic liquid and said conditioning agent, e. then forming a second suspension of said first agglomerates in a second hydrophobic organic liquid which is immiscible with water, f. adding to said second suspension an aqueous solution of a chemical reactive with iron to form a solid reaction product capable of binding together said first agglomerates, whereby to form a second two-phase liquid system containing said first agglomerates in suspension, g. agitating said second two-phase liquid system to effect repeated collisions of said first agglomerates and thereby forming in said system a dispersion of second, relatively large size agglomerates, said second agglomerates consisting essentially of agglomerates of said first, relatively small size agglomerates, and simultaneously effecting a chemical reaction between said chemical and iron present in said particles whereby to form said solid reaction product which binds together said first agglomerates to form said second agglomerates, h. discontinuing the agitation and recovering said second agglomerates substantially free of water and said second hydrophobic organic liquid.

2. A process according to claim 1 wherein following step h., the second agglomerates are calcined or sintered.

3. A process according to claim 1 wherein following step h., the second agglomerates are calcined in a reducing atmosphere to transform iron oxides to iron metal.

4. A process according to claim 1 wherein said reactive chemical is a mineral acid.

5. A process according to claim 1 wherein said reactive chemical is nitric acid.

6. A process according to claim 1 wherein in step e., mill scale particles are added to said second suspension.

7. A process according to claim 1 in which both of said first and second hydrophobic organic liquids are fuel oil.

8. A process according to claim 1, wherein in step d., said first agglomerates are separated by removing the freely removable water therefrom and then drying said first agglomerates to drive off more water, said first hydrophobic liquid and said conditioning agent.

9. A process according to claim 1 wherein in step h., said second agglomerates are recovered by removing the freely removable second hydrophobic organic liquid therefrom and then drying to drive off more of said second hydrophobic organic liquid and water.

10. A process for forming agglomerates from particles of iron-containing steel mill waste having a particle size of less than 10 mesh size, which comprises the steps of:

a. forming a pumpable slurry containing up to 25 wt. % of said steel mill waste particles suspended in water, b. adding to said slurry (i) from 3 to 15 wt. %, based on the weight of said slurry, of a first hydrophobic organic liquid which is immiscible with water and (ii) from 0.1 to 5 wt. %, based on the weight of said slurry, of a liquid conditioning agent effective to render the surfaces of said particles hydrophobic, whereby to form a two-phase liquid system containing said particles in suspension, c. agitating the two-phase liquid system to displace the water from the surfaces of said particles and to effect repeated collisions of said particles and thereby forming in said system a dispersion of first, relatively small size agglomerates in said first hydrophobic organic liquid, said first agglomerates having a particle size of from about 1/64 to ⅛ inch and consisting essentially of agglomerates of said steel mill waste particles in which said particles are connected together by liquid bridges of said hydrophobic organic liquid, d. discontinuing said agitation, removing freely drainable water from said first agglomerates and then drying said agglomerates to remove residual water, said first hydrophobic organic liquid and said conditioning agent whereby to obtain said first agglomerates in substantially dry condition, e. then feeding said substantially dry first agglomerates and a second hydrophobic organic liquid which is immiscible with water into an agglomerator and mixing same therein to form a second suspension of said first agglomerates in said second hydrophobic organic liquid, f. adding to said second suspension from 5 to 15 wt. %, based on the weight of said first agglomerates, of steel mill scale particles having a particle size of greater than about ⅛ inch, as a nucleating agent, and also adding to said second suspension an aqueous solution of a chemical reactive with iron to form a solid reaction product capable of binding together said first agglomerates, whereby to form a second two-phase liquid system containing said first agglomerates in suspension, g. agitating said second two-phase liquid system to effect repeated collisions of said first agglomerates and thereby forming in said system a dispersion of second, relatively large size agglomerates, said second agglomerates consisting essentially of agglomerates of said first, relatively small size agglomerates, and simultaneously effecting a chemical reaction between said chemical and iron present in said particles whereby to form said solid reaction product which binds together said first agglomerates to form said second agglomerates, h. discontinuing the agitation, removing freely drainable liquid from said second agglomerates and then drying said second agglomerates and thereby recovering said second agglomerates substantially free of water and said second hydrophobic organic liquid.

* * * * *